United States Patent [19]

Tusinski et al.

[11] 4,373,298

[45] Feb. 15, 1983

[54] AUTOMATIC EDGE BEVELLER FOR REMOVING THE SHARP PERIPHERAL EDGES OF OPHTHALMIC LENSES

[75] Inventors: Joseph Tusinski; Phillip D. Hill, both of Muskogee, Okla.

[73] Assignee: Coburn Optical Industries, Inc., Muskogee, Okla.

[21] Appl. No.: 229,911

[22] Filed: Jan. 30, 1981

[51] Int. Cl.[3] ..... B24B 5/14

[52] U.S. Cl. ..... 51/105 LG

[58] Field of Search ..... 51/105 R, 105 VG, 105 LG

[56] References Cited

U.S. PATENT DOCUMENTS

| | | | |
|---|---|---|---|
| 1,455,176 | 5/1923 | Simmons | 51/105 VG |
| 1,713,622 | 5/1929 | Rakel . | |
| 1,803,984 | 5/1931 | Van Norman | 51/105 VG |
| 2,778,163 | 1/1957 | Flygare | 51/105 VG |
| 3,121,979 | 2/1964 | Gray et al. . | |
| 3,315,415 | 4/1967 | Lannom . | |
| 3,332,172 | 7/1967 | Stern . | |
| 3,353,303 | 11/1967 | Stern . | |
| 3,405,482 | 10/1968 | Brandt . | |
| 3,449,866 | 6/1969 | Suddarth . | |
| 3,520,091 | 7/1970 | Raphael . | |
| 3,886,693 | 6/1975 | Tajnafoi et al. . | |

*Primary Examiner*—Harold D. Whitehead
*Attorney, Agent, or Firm*—John J. Byrne

[57] ABSTRACT

Disclosed is an automatic edge beveller for removing the sharp peripheral edges of ophthalmic lenses. It comprises (a) first apparatus for positioning an ophthalmic lens perpendicular to a first axis which extends through the lens, (b) second apparatus for rotating the lens about the first axis, (c) third apparatus for translating the ophthalmic lens parallel to the first axis, (d) a grinding wheel, and (e) fourth apparatus for rotating the grinding wheel about a second axis which intersects the first axis at an acute angle.

6 Claims, 7 Drawing Figures

AUTOMATIC EDGE BEVELLER FOR REMOVING THE SHARP PERIPHERAL EDGES OF OPHTHALMIC LENSES

TECHNICAL FIELD

This invention relates to the production of opthalmic lenses. More particularly, it relates to bevelling the edges of opthalmic lenses to remove their sharp peripheral edges.

BACKGROUND OF THE PRIOR ART

In the formation of an opthalmic lens, a lens disc or blank is first molded from glass or plastic. This blank is typically fashioned with a convex surface on one side and a concave surface on the other. In order to process the lens to a desired prescriptive value, the lens is then mounted upon a lens generator where a rotating grinding cup, mounted at an angle to a central longitudinal axis of the lens, is swept across the lens to produce a toroidal surface of compound prescriptive value. Illustrative examples of such lens generating equipment are shown in United States patents to Coburn U.S. Pat. No. 2,086,327; Suddarth U.S. Pat. No. 3,449,865; and Suddarth et al. U.S. Pat. No. 3,458,956, all assigned to the assignee of the subject application.

Following the initial generating operation, the opthalmic lens is fined and polished to a final prescriptive value. An illustrative example of an opthalmic lens finer and polisher is shown in a commonly assigned patent to Stith, U.S. Pat. No. 3,732,647. Left and right lenses are then mounted upon an edge grinding machine to cut the outer peripheral shape required of the lens in order to be compatible with eye glass frames. Illustrative examples of opthalmic lens edging machines are shown in United States patents to Grey et al. U.S. Pat. No. 3,121,979; Novak U.S. Pat. No. 3,555,739; Haddock U.S. Pat. No. 4,027,434; and Haddock U.S. Pat. No. 4,203,259, again all assigned to the assignee of the instant application.

After an opthalmic lens has been edged, a sharp ledge exists on the front and back perimeters of the lens. These ledges can be dangerous if they are left exposed, and they also increase the susceptibility of the lens to chipping. Accordingly, after the lens has been edged, the edge surfaces are bevelled to remove their sharp peripheral edges. Traditionally this task has been performed by a skilled individual who bevels the lens edges using a large rotating handstone. However, regardless of the individual's skill, close examination of the finished lens revealed tell-tale start and finish marks, as well as subtle changes in the angles of the bevels. Moreover, hand bevelling added materially to the cost and time required to produce opthalmic lenses.

OBJECTS OF THE INVENTION

It is, therefore, a general object of the invention to eliminate the need for hand bevelling of opthalmic lenses by highly skilled individuals.

It is a further object of the invention to provide a device which will bevel the edges of opthalmic lenses without leaving start and finish marks and without change in the angles of the bevels.

It is yet another object of the invention to provide a device which will bevel the edges of opthalmic lenses quickly and inexpensively.

Other objects and advantages of the invention will become apparent from the detailed description thereof given hereinafter.

BRIEF SUMMARY OF THE INVENTION

The invention is an automatic edge beveller for removing the sharp peripheral edges of opthalmic lenses. It comprises (a) first means for positioning an opthalmic lens perpendicular to a first axis which extends through the lens (b) second means for rotating the lens about the first axis, (c) third means for translating the opthalmic lens parallel to the first axis, (d) a grinding wheel, and (e) fourth means for rotating the grinding wheel about a second axis which intersects the first axis at an acute angle.

DETAILED DESCRIPTION OF THE INVENTION

Figure 3:
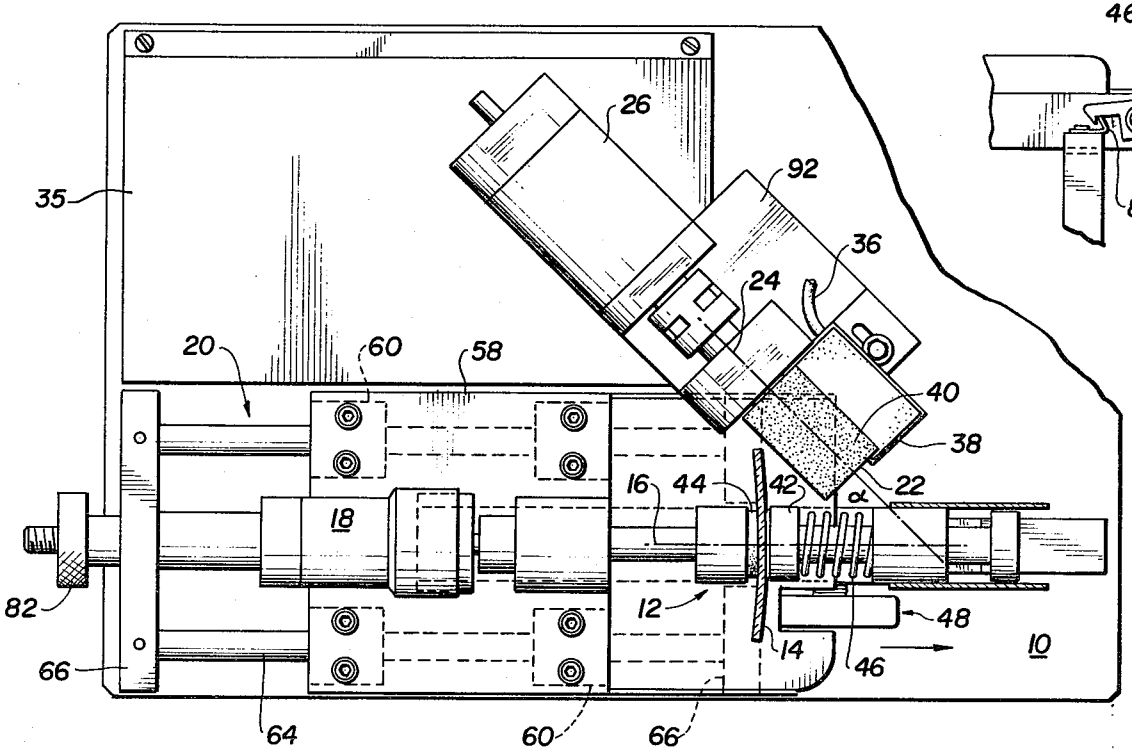
FIG. 3 is a top plan view of the presently preferred embodiment of the invention with the casing removed to expose the operative parts.
Figure 6:
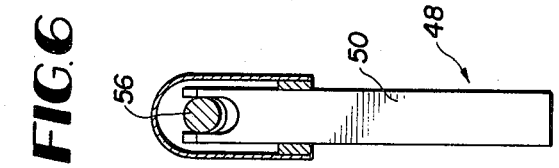
FIG. 6 is a view along the line 6—6 in FIG. 4.

The automatic edge beveller shown in the drawings comprises a baseplate 10, first means 12 for positioning an opthalmic lens 14 perpendicular to a first axis 16 which extends through the lens 14, second means 18 for rotating the lens 14 about the axis 16, third means 20 for translating the lens 14 parallel to the axis 16, a grinding wheel 22 mounted for rotation about a second axis 24 which intersects the axis 16 at an acute angle a shown in FIG. 3, fourth means 26 for rotating the grinding wheel 22 about the axis 24, and a casing 28 for protecting the elements to which access is not needed for ordinary operation.

Figure 1:
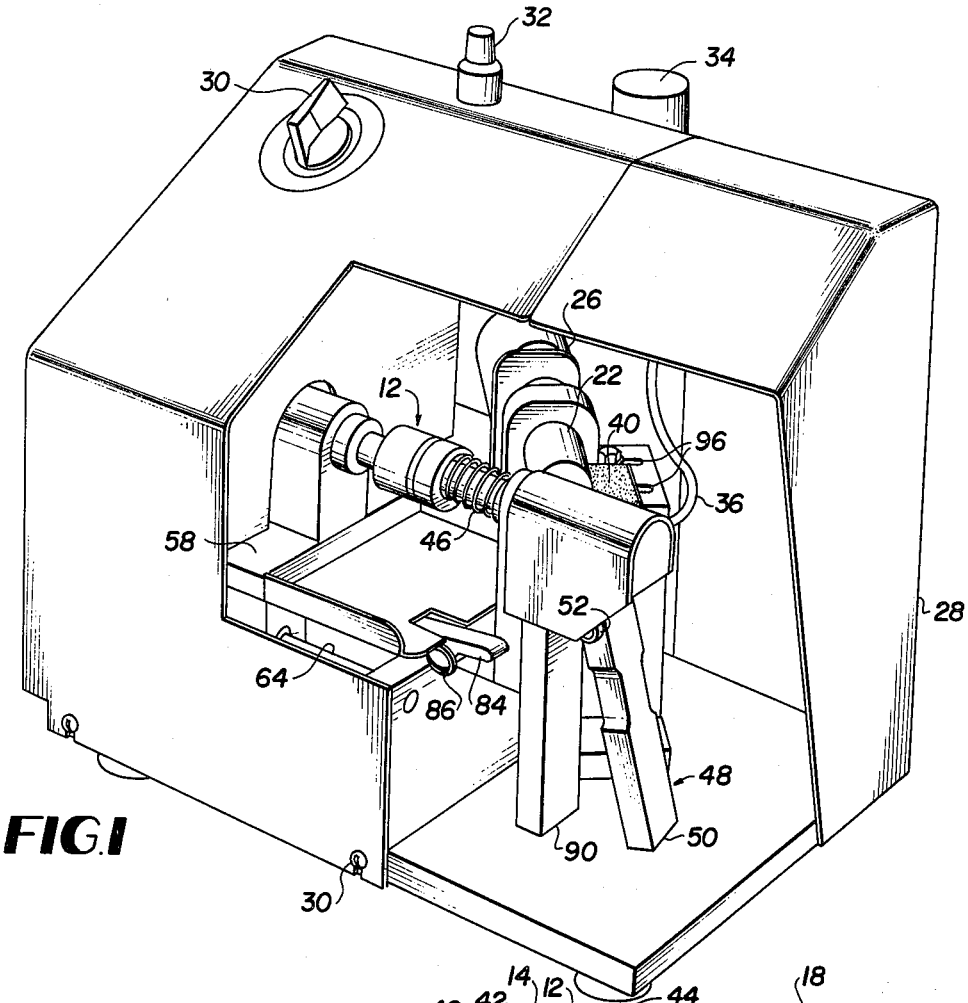
FIG. 1 is a front perspective view of the presently preferred embodiment of the invention.
Figure 2:
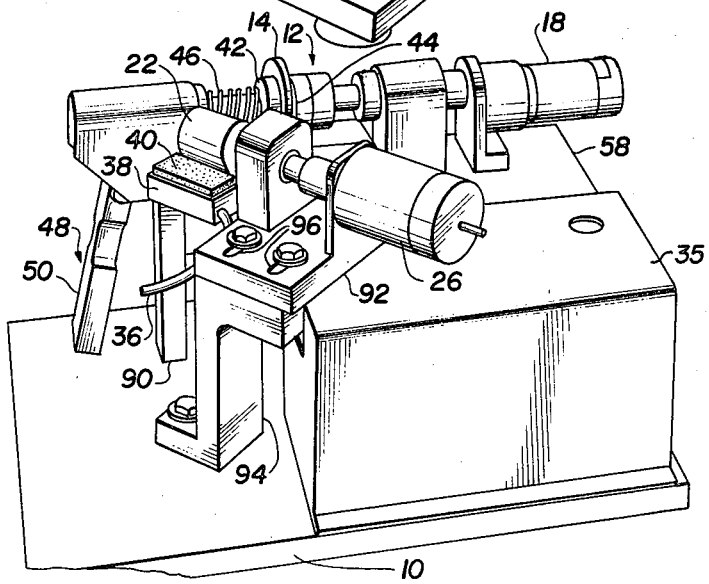
FIG. 2 is a rear perspective view of the presently preferred embodiment of the invention with the casing removed to expose the operative parts.

As shown at 30 in FIG. 1, the casing 28 is removably attached to the baseplate 10 by means which permit its ready removal for maintenance of the parts normally protected by the casing 28. FIG. 1 also shows a timer/-switch 30, a fuse 32, and a water reservoir 34, all of which protrude through the casing 28. The timer/-switch 30 controls operation of the second means 18 and the fourth means 26. The second means 18 and the fourth means 26 are both conventional electric rotary motors protected by the fuse 32 and powered by a DC power supply 35 which includes a stepdown transformer. The electric motors 18 and 26 are chosen to cause the lens 14 to rotate slowly and the grinding wheel 22 to rotate rapidly.

The water reservoir 34 is a flexible plastic container closed by a valve (not shown) and connected by tubing 36 to a water tray 38 containing a sponge 40 in contact with the working surface of the grinding wheel 22.

Squeezing the plastic container causes the valve to open, allowing water in the water reservoir 34 to flow through the tubing 36 to the water tray 38. Water in the water tray 38 wets the sponge 40, which in turn wets the working surface of the grinding wheel 22, serving as a coolant.

The first means 12 comprises a pair of clamps 42, 44 sized and shaped to grip the lens 14 therebetween such that the edge of the lens 14 projects radially outwardly from between the clamps 42, 44. At least one of the clamps 42, 44 (the clamp 44 in the illustrated embodiment) comprises a resillient pad. Fifth means 46 comprising a compression spring are provided for biasing the clamp 42 towards the clamp 44 to firmly grip the lens 14 during bevelling operations.

Figure 7:
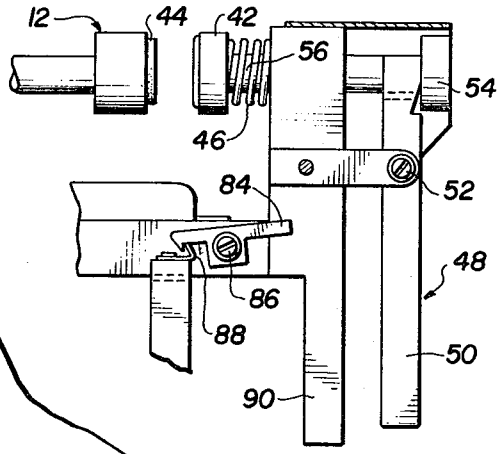
FIG. 7 is another fragmentary front side view on an enlarged scale of the presently preferred embodiment of the invention.
Figure 4:
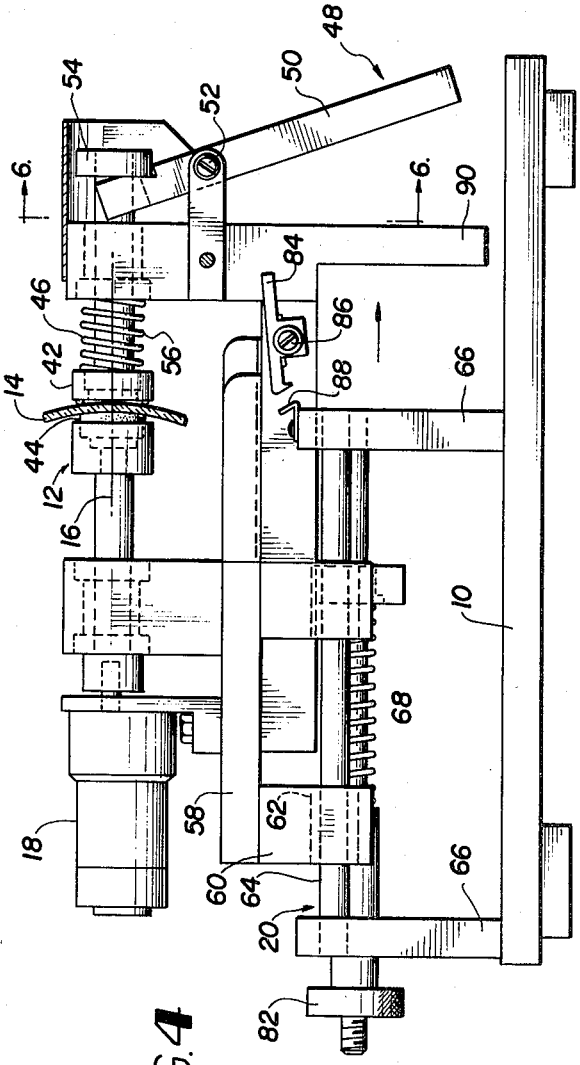
FIG. 4 is a front side view of the presently preferred embodiment of the invention with the casing removed to expose the operative parts.

Sixth means 48 are provided for moving the clamp 42 against the bias supplied by the fifth means 46. As best seen in FIGS. 4 and 7, the sixth means 48 comprises a lever 50 pivotably mounted at 52. The lever 50 engages a head 54 on a shaft 56 which carries the clamp 42, and clockwise actuation of the lever 50 (clockwise in FIGS. 4 and 7) causes the shaft 56 (and hence the clamp 42) to move to the right, compressing the spring 46 and opening the clamps 42, 44. Release of the lever 50 permits the spring 46 to close the clamps 42, 44.

The third means 20 comprises a carriage 58 on which the first means 12 and the second means 18 are mounted. Depending from the carriage are blocks 60 containing linear bearings 62. Linear ways 64 rigidly secured to blocks 66 are received in the linear bearings 62. The blocks 66 are in turn mounted on the baseplate 10. Thus, a lens 14 held by the clamps 42, 44 can be translated linearly by relative motion between the linear bearings 62 and the linear ways 64.

Figure 5:
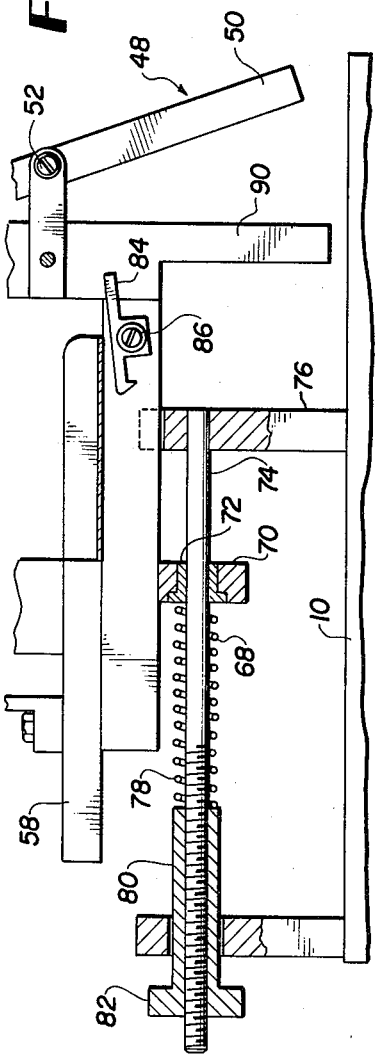
FIG. 5 is a fragmentary front side view, partly in section and on an enlarged scale, of the presently preferred embodiment of the invention.

As best seen in FIG. 5, the carriage 58 is biased towards the grinding wheel 22 by a compression spring 68. A block 70 containing a linear bearing 72 depends from the underside of the carriage 58. A rod 74 rigidly carried by a block 76 is received in the linear bearing 72, and the block 76 is mounted on the baseplate 10. The opposite end of the rod 74 is threaded at 78, and a collar 80 is threadedly mounted on the rod 74. The compression spring 68 abuts the collar 80 at one end and the linear bearing 72 at the other end, thereby biasing the carriage 58 and thus the lens 14 towards the grinding wheel 22. The collar 80 protrudes through the casing 28, and a handwheel 82 formed integrally with the collar 80 permits adjustment of the degree of rest compression in the compression spring 68.

A hook 84 pivoted on the carriage 58 at 86 engages a hook 88 mounted on the block 66 to hold the carriage 58, and thus the lens 14, away from the grinding wheel 22 against the bias of the spring 68. When the hook 84 is disengaged from the hook 88, the spring 68 urges the carriage to the right in the drawings, bringing the lens 14 into engagement with the grinding wheel 22. A handle 90 is provided for manually controlling the movement of the carriage 58 against the urging of the spring 68.

The grinding wheel 22, the water tray 38, and the motor 26 are all mounted on a baseplate 92 which in turn is mounted on a block 94 which is mounted on the baseplate 10. The grinding wheel 22, the water tray 38, and the motor 26 are fixedly mounted on the baseplate 92, and the block 94 is fixedly mounted on the baseplate 10, but arcuate slots 96 are provided in the baseplate 92 to permit the acute angle between the axis 16 and the axis 24 to be varied, thereby varying the angle of the bevel on the lens 14.

Operation

In operation, the water reservoir 34 is first squeezed to fill the water tray 38, wetting the sponge 40, and grinding wheel 22 is rotated to thoroughly wet its working surface. Then the lever is rotated clockwise to open the clamps 42, 44, and a lens 14 is inserted between them. It should be particularly noted that the lens 14 does not need to be centered in the clamps 42, 44. In fact, the farther the lens 14 is from center, the more evenly the grinding wheel 22 wears (assuming a round lens). Next, the motors 18 and 26 are turned on, and the hook 84 is disengaged from the hook 88, allowing the spring 68 to urge the lens 14 into engagement with the rotating grinding wheel 22. During this step, the carriage 58 should be restrained manually with the handle 90 in order to bring the lens 14 into contact with the grinding wheel 22 slowly and gently.

In the presently preferred embodiment, it requires approximately 7.5 seconds to complete one lens rotation, and, if the handwheel 82 is adjusted for moderate pressure, one rotation may be sufficient for the front-surface bevel. The carriage is then returned to its rest position by use of the handle 90 and locked in that position by engaging the hooks 84 and 88, after which the lens 14 is manually rotated to present the other edge surface to the grinding wheel 22. The hooks 84 and 88 are then disengaged, and the process is repeated to form the back-surface bevel. It has been found that it requires approximately three complete rotations of the lens to complete the back-surface bevel, but this of course is governed by lens configurations and laboratory practices.

It should be particularly noted that the lens contacts the grinding wheel 22 over a considerable circumferential area, which helps to distribute the stone wear.

Caveat

While the present invention has been illustrated by a detailed description of the presently preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. An edge beveller for removing the sharp peripheral edges of opthalmic lenses, said edge beveller comprising:

(a) a pair of clamps sized and shaped to grip the opthalmic lens therebetween such that the opthalmic lens is perpendicular to a first axis which extends through the opthalmic lens and the edge of the opthalmic lens projects radially outwardly from between said clamps;

(b) a first spring which biases a first one of said pair of clamps to resiliently grip the opthalmic lens therebetween;

(c) first means for rotating the opthalmic lens about the first axis;

(d) a grinding wheel mounted for rotation about a second axis set at an acute angle to the first axis;

(e) second means for rotating said grinding wheel about the second axis;

(f) a carriage on which said second one of said pair of clamps is mounted, said carriage being linearly movable in a direction parallel to said first axis;

(g) a second spring which biases said carriage towards said grinding wheel;

(h) third manually operable means actuation of which moves said first one of said pair of clamps against the bias supplied by said first spring;

(i) fourth manually operable means activation of which moves said second one of said pair of clamps against the bias supplied by said second spring; and (j) fifth manually operable means for locking said second one of said pair of clamps away from said grinding wheel against the bias of said second spring.

2. An edge beveller as recited in claim 1 and further comprising ninth means for wetting the working surface of said grinding wheel.

3. An beveller as recited in claim 1 and further comprising sixth means for varying the acute angle between the first and second axes.

4. An edge beveller as recited in claim 1 wherein the first axis intersects the second axis.

5. An edge beveller as recited in claim 1 wherein at least one of said clamps is a resillient pad.

6. An edge beveller as recited in claim 1 wherein said fifth means comprises two interengaging hooks at least one of which is mounted for pivotal movement.

* * * * *